US010445967B2

(12) United States Patent
Sato

(10) Patent No.: US 10,445,967 B2
(45) Date of Patent: Oct. 15, 2019

(54) COIN DISPENSING APPARATUS AND CHECKOUT MACHINE WITH THE SAME

(71) Applicant: TOSHIBA TEC KABUSHIKI KAISHA, Tokyo (JP)

(72) Inventor: Yusuke Sato, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 2 days.

(21) Appl. No.: 15/919,163

(22) Filed: Mar. 12, 2018

(65) Prior Publication Data

US 2018/0276930 A1 Sep. 27, 2018

(30) Foreign Application Priority Data

Mar. 23, 2017 (JP) ..... 2017-057624

(51) Int. Cl.

| | |
|---|---|
| ***G07D 1/06*** | (2006.01) |
| ***B65B 57/10*** | (2006.01) |
| ***G07D 3/14*** | (2006.01) |
| ***A47F 9/04*** | (2006.01) |
| ***G07D 11/22*** | (2019.01) |
| ***G07D 1/00*** | (2006.01) |
| ***G07D 1/02*** | (2006.01) |
| ***G07D 1/04*** | (2006.01) |

(Continued)

(52) U.S. Cl.

CPC ..... *G07D 1/06* (2013.01); *A47F 9/047* (2013.01); *B65B 57/10* (2013.01); *G07D 1/00* (2013.01); *G07D 1/02* (2013.01); *G07D 1/04* (2013.01); *G07D 1/08* (2013.01); *G07D 3/14* (2013.01); *G07D 11/22* (2019.01); *A47F 2009/041* (2013.01); *G07G 1/12* (2013.01)

(58) Field of Classification Search

CPC .. G07D 1/00; G07D 1/02; G07D 1/04; G07D 1/06; G07D 1/08; G07D 3/14; G07D 11/22; G07D 11/0036; G07G 1/12; A47F 9/047; A47F 2009/041; B65B 57/10

See application file for complete search history.

(56) References Cited

U.S. PATENT DOCUMENTS

| | | | |
|---|---|---|---|
| 2009/0057423 | A1 | 3/2009 | Nobuhara et al. |
| 2012/0199438 | A1 | 8/2012 | Taniike |

(Continued)

FOREIGN PATENT DOCUMENTS

| | | | |
|---|---|---|---|
| EP | 2 879 101 | A1 | 6/2015 |
| JP | 201413488 | A | 1/2014 |

OTHER PUBLICATIONS

Extended European Search Report dated Jul. 26, 2018, filed in counterpart European Patent Application No. 18163586.3 (7 pages).

*Primary Examiner* — Mark J Beauchaine

(74) *Attorney, Agent, or Firm* — Kim & Stewart LLP

(57) ABSTRACT

A coin dispensing apparatus includes a coin dispenser configured to dispense coins to a receiving tray, a sensor configured to detect one or more coins in the receiving tray, an output device, and a processor configured to control the output device to output a warning when the sensor detects no coins in the receiving tray after the processor instructs the coin dispenser to dispense a group of coins as change and the coin dispenser has dispensed at least one of the coins in the group but before the coin dispenser has dispensed all of the coins in the group.

20 Claims, 4 Drawing Sheets

(51) Int. Cl.
*G07D 1/08* (2006.01)
*G07G 1/12* (2006.01)

(56) References Cited

U.S. PATENT DOCUMENTS

2012/0217127 A1* 8/2012 Yasui ..... G07D 9/00
194/342
2017/0221294 A1* 8/2017 Niizuma ..... G07D 1/00

* cited by examiner

COIN DISPENSING APPARATUS AND CHECKOUT MACHINE WITH THE SAME

CROSS-REFERENCE TO RELATED APPLICATION

This application is based upon and claims the benefit of priority from Japanese Patent Application No. 2017-057624, filed Mar. 23, 2017, the entire contents of which are incorporated herein by reference.

FIELD

Embodiments described herein relate generally to a coin dispensing apparatus and a checkout machine having the coin dispensing apparatus.

BACKGROUND

Conventionally, there is a coin dispensing apparatus that sequentially dispenses a plurality of coins to a receiving tray, as change.

The coin dispensing apparatus of this type requires a certain amount of time from a start of the dispensing of the change to the completion of the dispensing. In other word, it takes time for a customer to have all coins dispensed to the receiving tray.

If coins are not dispensed smoothly, this may lead to an undesirable situation in which coins that are dispensed earlier are taken from the receiving tray and coins which are dispensed later are left in the receiving tray.

In particular, it is possible for the customer to misunderstand that the full amount of change has been dispensed completely without confirming it, if an interval is introduced between dispensing of coins which may occur as a result of, for example, a bug in the control program for conveyance of coins. In such a case, the situation described above may occur, and it would desirable to prevent the situation in which a customer unconsciously leaves some of the change dispensed to the receiving tray behind.

DETAILED DESCRIPTION

According to one embodiment, a coin dispensing apparatus includes a coin dispenser configured to dispense coins to a receiving tray, a sensor configured to detect one or more coins in the receiving tray, an output device, and a processor configured to control the output device to output a warning when the sensor detects no coins in the receiving tray after the processor instructs the coin dispenser to dispense a group of coins as change and the coin dispenser has dispensed at least one of the coins in the group but before the coin dispenser has dispensed all of the coins in the group.

One embodiment is described with reference to the accompanying drawings. In this embodiment, a self-service checkout apparatus including a function of a coin dispensing apparatus is described as an example.

Figure 1:
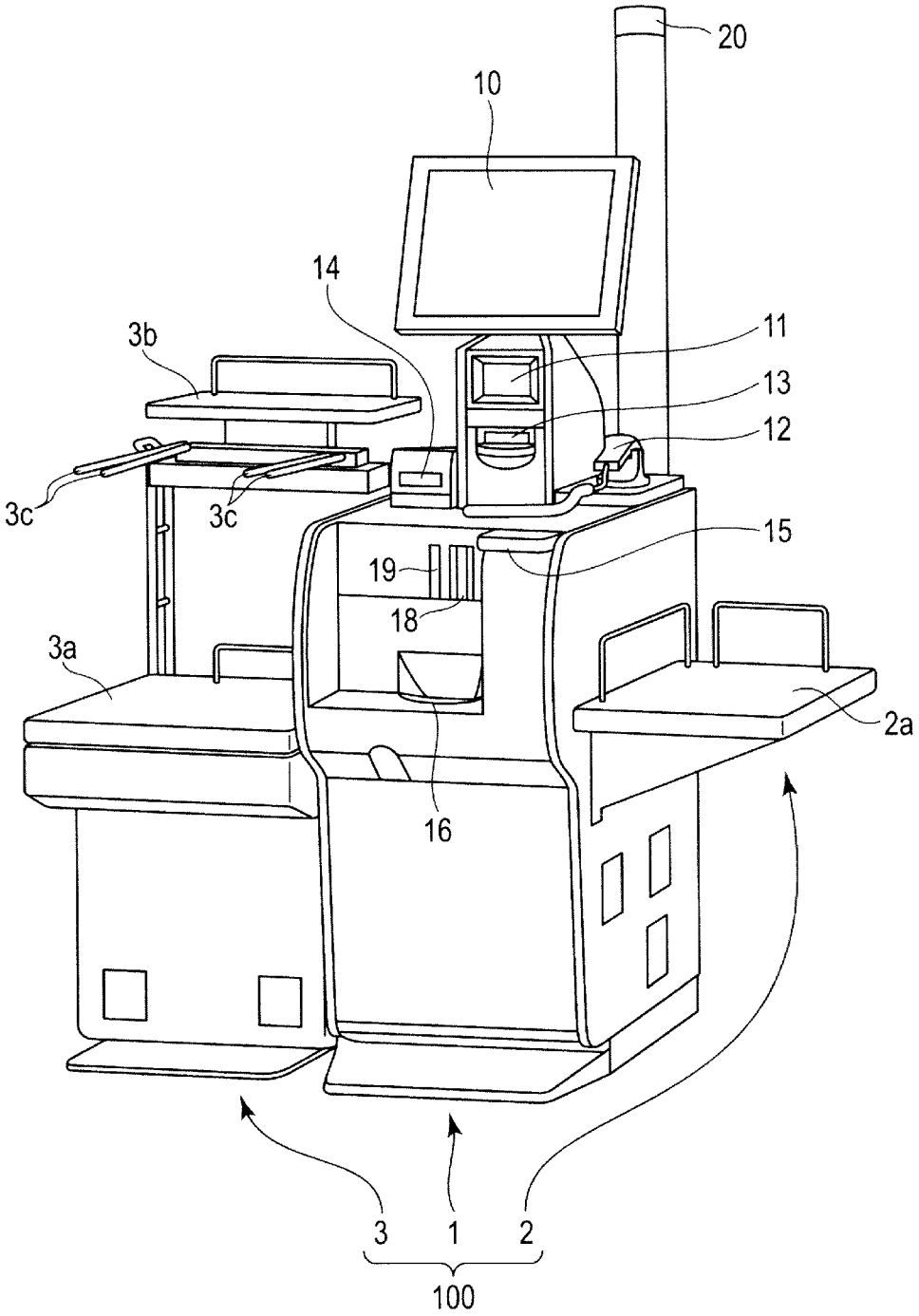
FIG. 1 is a perspective view illustrating the exterior of a self-service checkout apparatus according to an embodiment.
Figure 2:
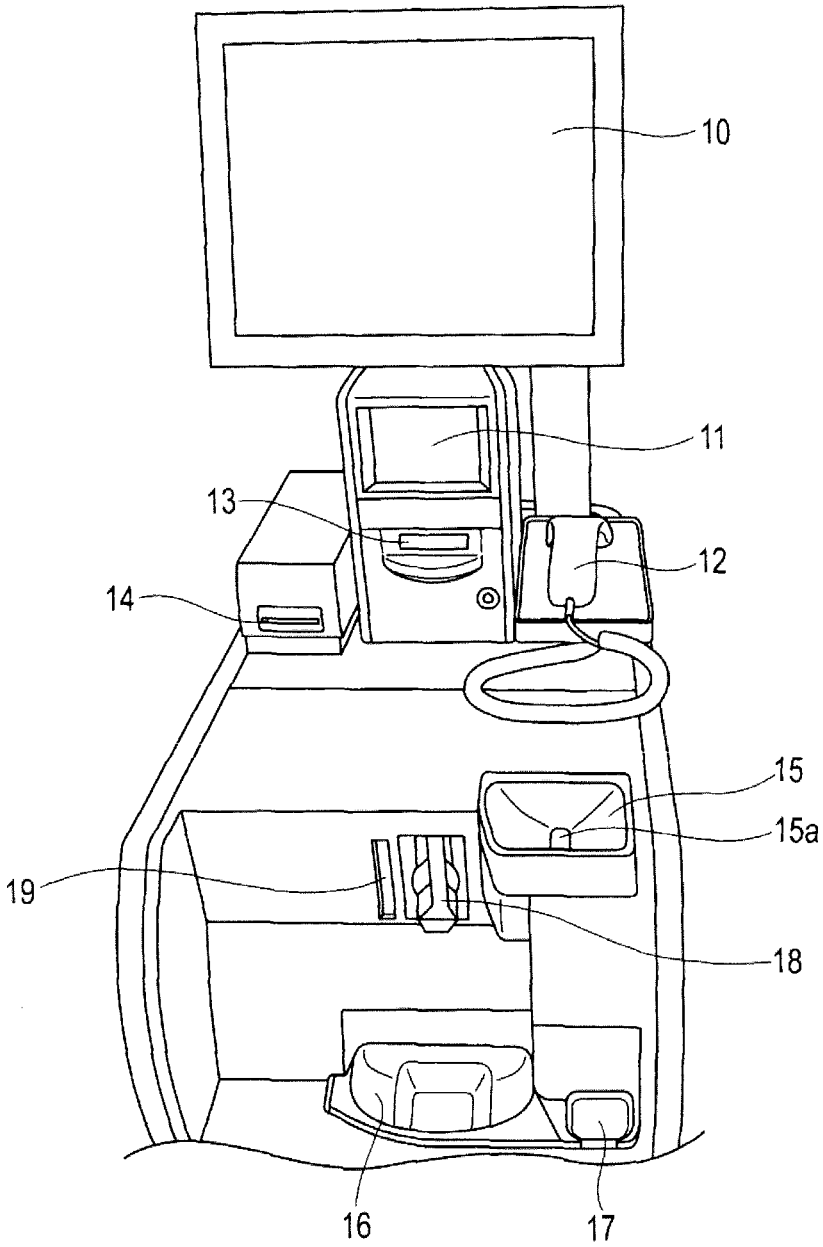
FIG. 2 is a perspective view illustrating a part of the self-service checkout apparatus shown in FIG. 1.

FIG. 1 is a perspective view of the exterior of a self-service checkout apparatus 100 according to the present embodiment. FIG. 2 is a perspective view illustrating a part of the self-service checkout apparatus 100. The self-service checkout apparatus 100 according to the present embodiment is also referred to as a POS terminal of a self-service checkout type or a self-service registration apparatus. The self-service checkout apparatus 100 is operated by a shopper. Therefore, the shopper acts as an operator of the self-service checkout apparatus 100. However, there is a case in which a store clerk also acts as the operator of the self-service checkout apparatus 100.

The self-service checkout apparatus 100 includes a main body 1 and weighing units 2 and 3.

The main body 1 includes a touch panel 10, a scanner window 11, a handy scanner 12, a receipt issue port 13, a card insertion port 14, a coin depositing tray 15, a receiving tray 16, a reject tray 17, a bill insertion port 18, a bill dispensing port 19, and a signal light 20.

The touch panel 10 displays various screens for notifying various kinds of information to the operator. The screens are, for example, followings:

(1) A guide screen for informing an operation method to the operator;

(2) An information input screen for inputting information of a commodity to which a barcode is not attached;

(3) A read-information display screen for displaying information based on barcode reading; and (4) A settlement screen for displaying a total purchase amount, a deposit amount, a change amount, and the like in payment work for paying a purchase price.

The screens include a GUI (Graphical User Interface). The touch panel 10 receives touch operation for the GUI.

The scanner window 11 covers an opening formed in the main body 1 with transparent resin, glass, or the like. The scanner window 11 enables a fixed scanner, described later, arranged in the main body 1 to scan a commodity held by the operator in front of the scanner window 11.

The handy scanner 12 reads a barcode displayed on a commodity and outputs information represented by the barcode.

The receipt issue port 13 is a slit-like opening for discharging a receipt to the outside of the main body 1.

The card insertion port 14 is a slit-like opening for inserting a card into the inside of the main body 1 and discharging the card to the outside of the main body 1.

The coin depositing tray 15 receives coins deposited by the operator for settlement. An opening 15*a* is formed in the bottom surface of the coin depositing tray 15. The coins received by the coin depositing tray 15 are taken into the inside of the main body 1 through the opening 15*a*.

The receiving tray 16 receives coins dispensed from the main body 1 as change.

The reject tray 17 receives coins rejected by the self-service checkout apparatus from the main body 1 as unusable or invalid coins.

The bill insertion port 18 is a slit-like opening into which the operator inserts bills for settlement.

The bill dispensing port 19 is a slit-like opening for dispensing bills from the main body 1 as change. The bill dispensing port 19 retains the bills in a state in which a part of the bills are projected to the outside of the main body 1.

The signal light 20 performs a flashing for warning.

The weighing unit 2 includes a table 2*a* for placing commodities not yet registered. The weighing unit 2 measures a total weight of the commodities placed on the table 2*a*.

The weighing unit 3 includes tables 3*a* and 3*b* for placing registered commodities and arms 3*c* for hanging a bag in which registered commodities are put. The weighing unit 3 measures a total weight of the commodities placed on the tables 3*a* and 3*b* and the commodities put in the bag hung on the arms 3*c*.

Figure 3:
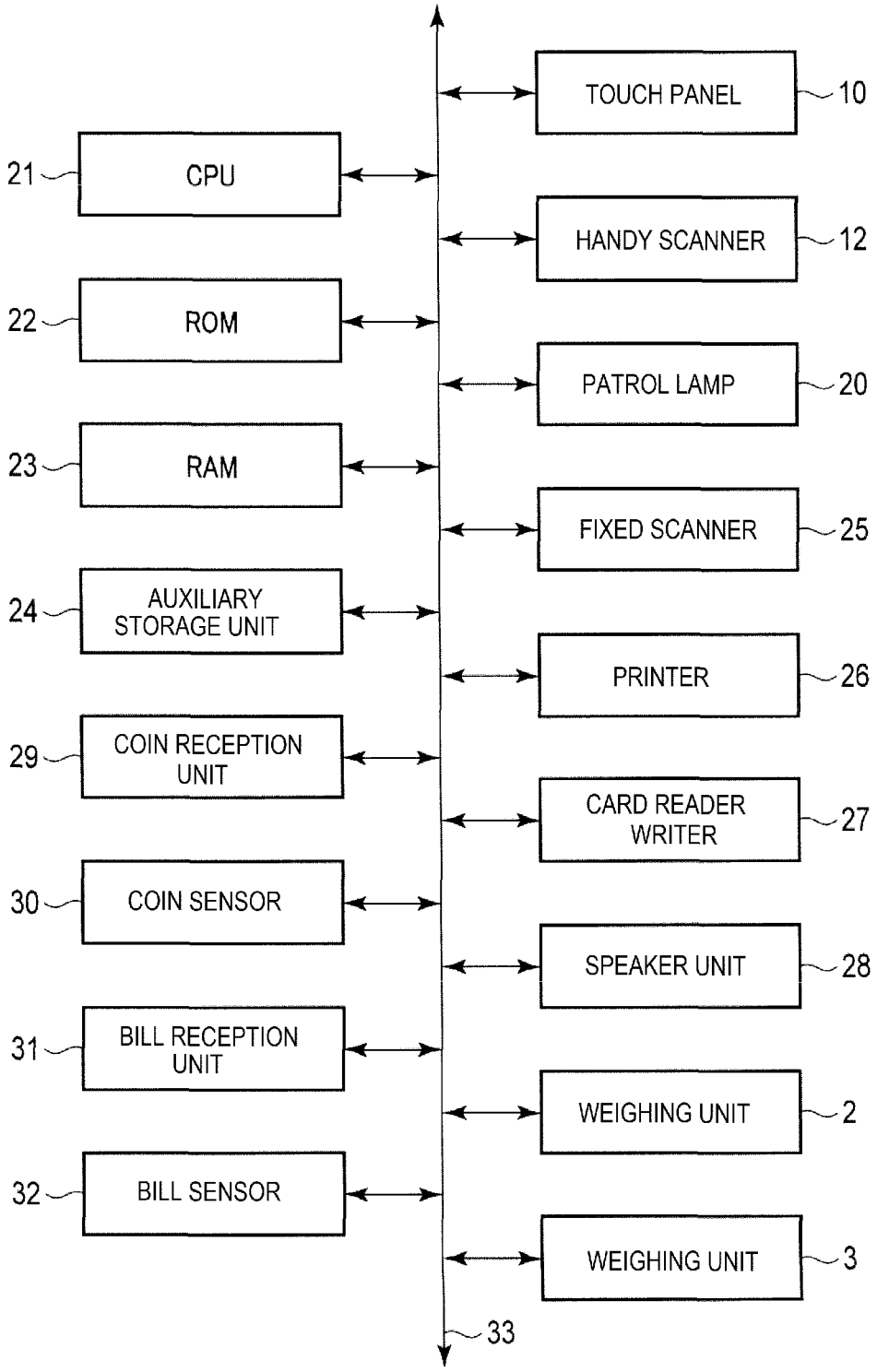
FIG. 3 is a block diagram main circuit components of the self-self-service checkout apparatus shown in FIG. 1.

FIG. 3 is a block diagram of main circuit components of the self-service checkout apparatus 100. In FIG. 3, the same components as in FIGS. 1 and 2 are denoted by the same reference numbers and thus detailed explanation thereof is omitted.

As shown in FIG. 3, the self-service checkout apparatus 100 includes the weighing units 2 and 3, the touch panel 10, the handy scanner 12, and the signal light 20, a CPU (Central Processing Unit) 21, a ROM (Read-Only Memory) 22, a RAM (Random-Access Memory) 23, an auxiliary storage unit 24, a fixed scanner 25, a printer 26, a card reader/writer 27, a speaker unit 28, a coin reception unit 29, a coin sensor 30, a bill reception unit 31, a bill sensor 32, and a communication system 33, all of which are housed in the main body 1. The weighing units 2 and 3, the touch panel 10, the handy scanner 12, the CPU 21, the ROM 22, the RAM 23, the auxiliary storage unit 24, the fixed scanner 25, the printer 26, the card reader writer 27, the speaker unit 28, the coin reception unit 29, the coin sensor 30, and the bill reception unit 31 are connected via the communication system 33. Consequently, a computer that controls the self-service checkout apparatus 100 includes the CPU 21, the ROM 22, the RAM 23, and the auxiliary storage unit 24.

The CPU 21 acts is a central processing unit of the computer. The CPU 21 controls each section according to an operating system and application programs stored in the ROM 22 and the auxiliary storage unit 24 to realize various functions of the self-service checkout apparatus 100.

The ROM 22 stores the operating system and the application programs. The ROM 22 stores data referred to by the CPU 21 in performing various kinds of processing in some cases.

The RAM 23 stores data referred to by the CPU 21 in performing the various kinds of processing. Further, the RAM 23 serves as a work area in which data temporarily used by the CPU 21 in performing the various kinds of processing is stored.

The auxiliary storage unit 24 saves the data used by the CPU 21 in performing the various kinds of processing or data generated in the processing by the CPU 21. The auxiliary storage unit 24 stores the application programs in some cases. As the auxiliary storage unit 24, for example, an EEPROM (Electric Erasable Programmable Read-Only Memory), a HDD (Hard Disk Drive), or a SSD (Solid State Drive) can be used.

The fixed scanner 25 scans a commodity held over in front of the scanner window 11 to recognize a barcode attached to the commodity with an image processing. The fixed scanner 25 outputs information, i.e., commodity code, represented by the recognized barcode to the CPU 21. The fixed scanner 25 also includes a device of another type that reads a barcode using reflection of laser light.

The printer 26 includes a receipt printer and a journal printer. The receipt printer issues various vouchers by printing various kinds of information on a receipt sheet. The various vouchers are, for example, a receipt on which content and the like of a commercial transaction is printed. The vouchers issued by the receipt printer are discharged to the outside of the main body 1 from the receipt issue port 13. A journal printer prints, on a journal sheet, journal data including the information printed on the receipt sheet by the receipt printer. The journal sheet is retained inside the main body 1 as long as the journal sheet is not taken out by a maintenance person.

The card reader/writer 27 reads data recorded in a card inserted into the card insertion port 14 by the operator. The card reader/writer 27 writes data in the card. The card includes a point card, an IC card, e.g., electronic money card, for settlement, and the like. The card reader/writer 27 ejects the card to the outside of the main body 1 from the card insertion port 14 after processing necessary to the settlement is carried out. The card insertion port 14 retains the card in a state in which a part of the card is projected to the outside of the main body 1.

The speaker unit 28 includes a speaker and a driving circuit. The speaker unit 28 outputs sound or a synthetic voice under the control by the CPU 21.

The coin reception unit 29 stores coins taken into the inside of the main body 1 from the opening 15*a* of the coin depositing tray 15. The coin reception unit 29 dispenses coins as change to the receiving tray 16. The coin reception unit 29 is an example of a dispensing module.

The coin sensor 30 detects coins dispensed to the receiving tray 16. Various devices such as a device that detects a magnetic field change generated due to approach of a coin and a device that detects presence or absence of coin blocking an optical path can be used as a coin sensor. The coin sensor 30 is an example of a detecting module.

The bill reception unit 31 stores bills inserted from the bill insertion port 18. The bill reception unit 31 dispenses bills as change from the bill dispensing port 19.

The bill sensor 32 detects bills retained by the bill dispensing port 19. Various devices such as a device that detects a magnetic field change generated due to approach of a bill and a device that detects presence or absence of bill blocking an optical path can be used as a bill sensor.

The communication system 33 includes a system bus for transmitting data and signals transmitted/received to or from each section and an interface circuit for connecting each section to the system bus.

Next, the operation of the self-service checkout apparatus 100 above will be described.

If the self-service checkout apparatus 100 is in a standby state, the CPU 21 waits for various instructions to be given. The CPU 21 starts information processing according to an application program stored in the ROM 22 or the auxiliary storage unit 24 if operation for instructing implementation of settlement in a commercial transaction is performed, for example, on the touch panel 10.

Figure 4:
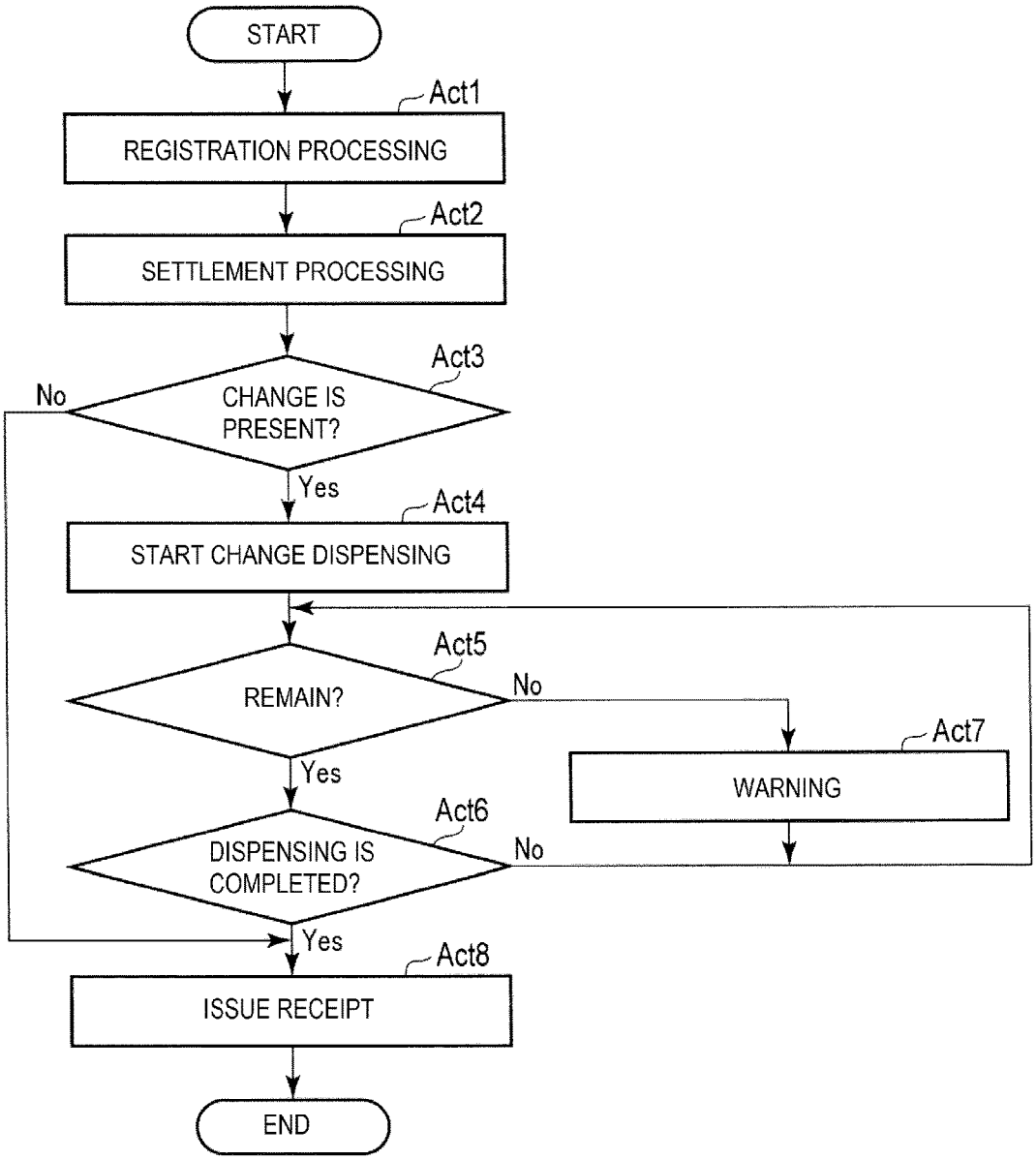
FIG. 4 is a flowchart illustrating information processing by a CPU of the self-service checkout apparatus in FIG. 1 according to an application program.

FIG. 4 is a flowchart illustrating information processing by the CPU 21 according to the application program. Content of the processing described below is an example. Various kinds of processing capable of achieving the same result can be used appropriately.

In Act 1, the CPU 21 performs registration processing for registering a purchased commodity. Specifically, the CPU 21 waits for registration operation by the operator. The registration operation includes, for example, operation for holding the purchased commodity in front of the scanner window 11, operation for bringing the handy scanner 12 close to a barcode affixed on the purchased commodity, or operation for touching the touch panel 10 to designate the purchased commodity.

If the purchased commodity is held in front of the scanner window 11, the fixed scanner 25 recognizes the barcode affixed on the purchased commodity by image processing, and information represented by the barcode is sent to the CPU 21. If the handy scanner 12 is brought close to the barcode, the handy scanner 12 identifies the barcode to send the information represented by the barcode to the CPU 21. If the operation for touching the touch panel 10 is performed to designate the purchased commodity, the touch panel 10 sends position information thereon at which a touch operation is performed to the CPU 21.

The CPU 21 determines a commodity code included in the information sent from the fixed scanner 25 or the handy scanner 12, or a commodity code associated with the touch position sent from the touch panel 10 as a commodity code of the purchased commodity. The CPU 21 updates information in a commodity list area set in the RAM 23 to add the commodity identified by the commodity code to a list of purchased commodities.

If registration of all purchased commodities is finished and operation for instructing implementation of settlement processing is performed, for example, on the touch panel 10, the CPU 21 ends the registration processing and proceeds to processing in Act 2.

In Act 2, the CPU 21 performs settlement processing. Specifically, the CPU 21 calculates a settlement amount of all of the registered and purchased commodities. The CPU 21 executes settlement processing for the calculated settlement amount with a settlement method designated by the operator out of a plurality of settlement methods. Various settlement methods for performing settlement with cash, a credit card, a debit card, a prepaid card, an electronic money, a point, a note, and the like can be used appropriately, as a settlement method.

In Act 3, the CPU 21 confirms whether or not change is required as a result of the settlement processing. If it is determined that change is required, Yes is taken in Act 3 and the CPU 21 proceeds to processing in Act 4.

In Act 4, the CPU 21 determines the numbers of coins and bills to be dispensed of each kind on the basis of a change amount calculated in the settlement processing. For the coins to be dispensed, the CPU 21 instructs the coin reception unit 29 to start dispensing. For the bills to be dispensed, the CPU 21 instructs the bill reception unit 31 to start dispensing. The CPU 21 executes the information processing according to the application program in this way, and thus the computer including the CPU 21 functions as an instructing module. The coin reception unit 29 and the bill reception unit 31 dispense coins and bills as change in response to the instruction. The dispensed coins and bills are retained by the receiving tray 16 and the bill dispensing port 19. If it is necessary to dispense a plurality of bills as change, the bill reception unit 31 dispenses the pertinent number of bills at once as a bill bundle. However, the coin reception unit 29 sends coins stored in each storage one by one for each coin denomination and sequentially dispenses the coins to the receiving tray 16. If a first coin is dispensed to the receiving tray 16, the coin sensor 30 changes its state to a state in which coins are being detected.

In Act 5, the CPU 21 confirms whether or not the coins dispensed as described above remain on the receiving tray 16. If the coin sensor 30 detects coins (Yes in Act 5), the CPU 21 proceeds to processing in Act 6.

In Act 6, the CPU 21 confirms whether or not dispensing of all coins is completed. If the coins are being dispensed, in other words, dispensing of coins is still continuing (No in Act 6), the CPU 21 returns to processing in Act 5.

In this way, in Act 5 and Act 6, the CPU 21 waits for all of the dispensed coins to be removed or dispensing of all coins as change to be completed. If the operator removes all of the dispensed coins, where some of the coins has not yet been dispensed to the receiving tray 16, the coin sensor 30 will not detect any coins. Then (No in Act 5), the CPU 21 proceeds to processing in Act 7. At this point, the coin reception unit 29 continues the operation for dispensing of coins, in other words, the coin reception unit 29 will be dispensing coins. If the next coin is dispensed, the coin sensor 30 changes its state to the state in which coins are being detected again.

In Act 7, the CPU 21 executes a warning operation for notifying the operator that change is being dispensed. One of the warning operations is a control of the speaker unit 28 for outputting warning sound or a voice message decided in advance for the notification. Another one of the warning operations is a control of the touch panel 10 for displaying at least one of a character message and an image decided in advance for the notification. Still another one of the warning operations is a control of the signal light 20 decided in advance for the notification (e.g., flashing light). In Act 7, the CPU 21 executes one or a plurality of warning operations out of these warning operations described above. Consequently, the operator is notified that change is still being dispensed with the output of the warning sound or the voice message, the display of at least one of the character message and the image, or the lighting. The CPU 21 executes the information processing according to the application program in this way, and thus the computer including the CPU 21 functions as a warning module. The CPU 21 returns to the waiting state in Act 5 and Act 6.

If the coin reception unit 29 completes the dispensing of all coins as change, Yes is taken in Act 6 and the CPU 21 proceeds to processing in Act 8.

In Act 8, the CPU 21 issues a receipt. Specifically, the CPU 21 generates data of a receipt image representing content of a commercial transaction at this time to send the data to the printer 26. The printer 26 prints the receipt image indicated by the data sent from the CPU 21 on a receipt sheet with the receipt printer and discharges the receipt from the receipt issue port 13. If the CPU 21 ends the issuance of the receipt in this way, the CPU 21 ends the information processing shown in FIG. 4.

As described above, according to the self-service checkout apparatus 100 of the present embodiment, if all coins already dispensed are taken away from the receiving tray 16 while the coins are dispensed, the operator is notified that the change is still being dispensed. Therefore, the operator can recognize that the dispensing of the coins is still being performed. In other words, the operator can recognize that change is further dispensed. Thus, it can prevent coins that are dispensed later from being left in the receiving tray 16.

Various modified implementations of the present embodiment are possible as described below.

As an example of termination of the warning operation, operation executed according to the warning operation by the CPU 21 may end after a predetermined period elapses. However, if the warning operation is performed until completion of the dispensing of all the coins when coins cannot be detected by the coin sensor 30, the embodiment can better prevent the situation where the operator forgets to take the coins. However, for example, in a case of outputting the warning sound, a continuation time of the warning sound overly increases. Therefore, the sound may trouble other people around the coin dispensing apparatus and cause embarrassment. Therefore, a button for terminating the warning operation or stopping the warning sound may be prepared on the warning screen. The warning may be ended if the button is touched.

Even if the operator takes the coins away from the receiving tray 16 during the dispensing of the coins, the CPU 21 may misunderstand that the coins have all been dispensed depending on a dispensing state of coins immediately after the coins are taken away. Thus, the CPU 21 may perform the warning operation according to a decrease in the amount of coins present in the receiving tray 16 during the dispensing of the coins. Specifically, a detection device of a type capable of detecting a change in the amount of the coins present in the receiving tray 16 is used as the coin sensor 30. Then, the CPU 21 confirms whether the amount of the coins detected by the coin sensor 30 decreases in Act 5. Upon determining that the amount of the coins does not decrease, the CPU 21 proceeds to processing in Act 6. Upon determining that the amount of the coins decreases, the CPU 21 proceeds to processing in Act 7. Note that, the CPU 21 may perform the warning operation if it can be detected that there is a probability that the coins are taken out. For example, if a hand is inserted into the receiving tray 16, the CPU 21 may conclude that the coins are likely to be taken out. Alternatively, presence or absence of coins in a plurality of regions of the receiving tray 16 is detected in advance. If the state of the coin sensor is changed from a state in which coins are detected to a state in which no coin is detected in any one of the regions, the CPU 21 detects that there is a probability that the coins are taken out.

After Yes in Act 6, the CPU 21 executes processing in Act 8 after coins cannot be detected anymore by the coin sensor 30. In this way, the receipt is issued after all coins dispensed as the change has been taken away from the receiving tray 16. Therefore, if the operator forgets to take the coins dispensed to the receiving tray 16, the receipt is not issued. The operator can become aware of forgetting to take the coins because of no receipt being issued.

Alternatively, the CPU 21 may perform the issuance of the receipt between Act 2 and Act 3.

The present invention can be applied to another checkout apparatus where the shopper mainly performs operation for settlement (referred to as a semi-self-service type) or a checkout apparatus where the store clerk mainly performs operation for settlement (referred to as a face-to-face type). The invention can be also applied to a settlement apparatus that performs settlement in a transaction registered by another registration apparatus. It is also possible to apply the invention to an apparatus not including a function of settlement such as an automatic change machine. Further, it is also possible to realize the invention as a coin dispensing apparatus including only a function of dispensing of coins.

The warning operation is not limited to operation for directly notifying warning to the operator who takes out the coins from the receiving tray 16. For example, notification is made to the store clerk and then the store clerk may remind the operator of coins left in the receiving tray 16.

In general, a delivery of the self-service checkout apparatus 100 as product to a customer is performed in a state in which the application program concerning the information processing shown in FIG. 4 is stored in the ROM 22. However, a hardware of the self-service checkout apparatus 100 may be delivered to the customer in a state in which the application program is not stored in the ROM 22. Alternatively, the delivery of the hardware of the self-service checkout apparatus 100 to the customer may be performed in a state in which an application program of a version different from the application program concerning the information processing shown in FIG. 4 is stored in the ROM 22. In these cases, the application program concerning the information processing shown in FIG. 4 is delivered to the customer separately from the hardware while being recorded in a removable recording medium or via a network. The application program is written in the auxiliary storage unit 24, for example, according to operation by the customer. As the removable recording medium, a magnetic disk, a magneto-optical disk, an optical disk, a semiconductor memory, or the like can be used.

A part or all of the functions realized by the CPU 21 according to the information processing can also be realized by hardware that executes information processing not based on a program such as a logic circuit. Each of the functions can also be realized by combining software control with the hardware such as the logic circuit.

While certain embodiments have been described, these embodiments have been presented by way of example only, and are not intended to limit the scope of the invention. Indeed, the novel methods and systems described herein may be embodied in a variety of other forms; furthermore, various omissions, substitutions and changes in the form of the methods and systems described herein may be made without departing from the spirit of the invention.

What is claimed is:

1. A coin dispensing apparatus comprising:

a coin dispenser configured to dispense coins to a receiving tray;

a sensor configured to detect one or more coins in the receiving tray;

an output device; and a processor configured to control the output device to output a warning when the sensor detects no coins in the receiving tray after the processor instructs the coin dispenser to dispense a group of coins as change and the coin dispenser has dispensed at least one of the coins in the group but before the coin dispenser has dispensed all of the coins in the group.

2. The apparatus according to claim 1, wherein the output device is an audio output device that generates an audible alarm or a voice message as the warning.

3. The apparatus according to claim 1, wherein the output device is a signal light that generates a flashing light as the warning.

4. The apparatus according to claim 1, wherein the output device is a display device that displays a message and an image as the warning.

5. The apparatus according to claim 1, wherein the processor is configured to control the output device to terminate the warning after a predetermined amount of time passes after the output of the warning.

6. The apparatus according to claim 1, further comprising:

a touch screen on which a graphical user interface (GUI) is displayed, and the GUI includes a button which, when selected, causes the warning to be terminated.

7. A checkout machine comprising:

a coin dispenser configured to dispense coins to a receiving tray;

a sensor configured to detect one or more coins in the receiving tray;

a receipt printer;

an output device; and a processor configured to control the receipt printer to print a receipt that indicates an amount of change that is to be dispensed, and upon determining that a group of coins is to be dispensed as change, to control the output device to output a warning when the sensor detects no coins in the receiving tray after the processor instructs the coin dispenser to dispense the group of coins and the coin dispenser has dispensed at least one of the coins in the group but before the coin dispenser has dispensed all of the coins in the group.

8. The machine according to claim 7, wherein the output device is an audio output device that generates an audible alarm or a voice message as the warning.

9. The machine according to claim 7, wherein the output device is a signal light that generates a flashing light as the warning.

10. The machine according to claim 7, wherein the output device is a display device that displays a message and an image as the warning.

11. The machine according to claim 7, wherein the processor is configured to control the output device to terminate the warning after a predetermined amount of time passes after the output of the warning.

12. The machine according to claim 7, further comprising:

a touch screen on which a graphical user interface (GUI) is displayed, and the GUI includes a button which, when selected, causes the warning to be terminated.

13. The machine according to claim 7, wherein the receipt printer prints the receipt only after the coin dispenser has dispensed all of the coins in the group.

14. The machine according to claim 7, wherein the receipt printer prints the receipt before the coin dispenser dispenses any of the coins in the group.

15. In a transaction where coins are dispensed as change, a method of issuing a warning upon detecting that not all coins to be dispensed as the change may be removed from a coin receiving tray, said method comprising:

determining an amount of change in the transaction;

dispensing a group of coins as the change to the coin receiving tray;

detecting presence or absence of one or more coins in the coin receiving tray; and outputting a warning when no coins are detected in the receiving tray after at least one coin in the group has been dispensed but before all of the coins in the group has been dispensed.

16. The method according to claim 15, wherein the warning is an audible alarm or a voice message.

17. The method according to claim 15, wherein the warning is a flashing light.

18. The method according to claim 15, wherein the warning is outputted onto a display as a message and an image.

19. The method according to claim 15, further comprising:

terminating the warning after a predetermined amount of time has passed after the outputting of the warning.

20. The method according to claim 15, further comprising:

generating a graphical user interface (GUI) on a touch screen, wherein the GUI includes a button which, when selected, causes the warning to be terminated.

* * * * *